United States Patent [19]

Di Marco et al.

[11] 4,266,209

[45] May 5, 1981

[54] CIRCUIT BREAKER HANDLE AND LOST MOTION CONNECTED SHIELD

[75] Inventors: Bernard Di Marco, Bellefontaine; Andrew J. Kralik, Marysville, both of Ohio

[73] Assignee: Gould Inc., Rolling Meadows, Ill.

[21] Appl. No.: 92,864

[22] Filed: Nov. 9, 1979

[51] Int. Cl.[3] ..... H01H 9/02; H01H 13/04

[52] U.S. Cl. ..... 335/6; 200/304; 335/17; 335/202

[58] Field of Search ..... 335/35, 17, 202, 201, 335/6; 200/304, 302

[56] References Cited

U.S. PATENT DOCUMENTS

| | | | |
|---|---|---|---|
| 1,780,684 | 11/1930 | Owens | 200/304 |
| 3,137,780 | 6/1964 | Powell | 200/304 |
| 3,319,035 | 5/1967 | Gelzheiser | 200/304 |
| 3,341,791 | 9/1967 | Leonard | 335/35 |

*Primary Examiner*—Harold Broome

*Attorney, Agent, or Firm*—Harold Huberfeld; Jerome M. Berliner; Bernard Gerb

[57] ABSTRACT

A molded elongated arcuate shield is snap-fitted to a circuit breaker operating handle to achieve a lost motion connection thereto. The operating handle projects through an elongated wall opening in the circuit breaker housing and is movable longitudinally thereof. The shield is disposed between an arcuate interior surface of housing and an arcuate surface of an apron formed integrally with the handle. While the apron above is too short to close the wall opening for all positions of the handle, the apron in cooperation with the shield fully closes the wall opening for all positions of the handle. Latch tabs formed integrally with the shield engage a blocking formation internally of the housing to hold the shield stationary while the handle moves from its On to Trip position. In the former position ON indicia carried by the apron is viewable through an aperture in the shield through which the handle extends, and when the handle is in its Trip position the latched shield blocks the ON indicia from view. Labyrinth-type gas seals are provided adjacent the longitudinal edges of the wall aperture by longitudinally extending ribs formed integrally with the shield and extending into cooperating slots inside the housing wall.

12 Claims, 6 Drawing Figures

CIRCUIT BREAKER HANDLE AND LOST MOTION CONNECTED SHIELD

This invention relates to molded case circuit breakers in general and more particularly to a movable shield for the housing aperture through which the manual operating handle extends.

In a typical molded case circuit breaker having an aperture through which a manual operating handle extends, the handle is provided with an apron so that the handle aperture is closed for all positions of the handle. As the range of motion for the circuit breaker handle is increased the length of the aperture must be increased and the length of the apron must also be increased. In order to prevent apron length from becoming excessive while still permitting large movement of the handle, a separate shield member is movably mounted on the handle. This type of construction is illustrated in U.S. Pat. No. 3,341,791, issued Sept. 12, 1967 to J. H. Leonard for an Electric Circuit Breaker With Improved Operating Mechanism. More particularly, the aforesaid U.S. Pat. No. 3,341,791 illustrates a multipole molded case circuit breaker in which the manual operating handle protrudes through an opening in the cover for the circuit breaker housing. The handle is provided with a relatively short apron which does not fully close the cover opening when the handle is at either of its extreme positions. Thus, a resiliently flexible sealing member or shield is mounted on the handle to cooperate with the apron to fully close the handle opening for all positions of the handle. The shield is formed from a flat sheet of material and is sandwiched between the arcuate outwardly facing surface of the apron and the internal arcuate surface portion of the cover.

In the aforesaid U.S. Pat. No. 3,341,791 the shield is not positively secured to the handle so that these parts may readily separate during assembly of the circuit breaker, during installation or exchange of accessories and/or during replacement of trip units in the field. Separations of the shield from the handle could readily go undetected since under normal conditions circuit breaker operation will not be affected. However, when closing on a fault, hot gases will exit through the handle opening and injure the operator. To alleviate this condition, the instant invention captivates the shield to the handle and does so without adding an assembly step.

Another undesirable feature of the construction illustrated in the aforesaid U.S. Pat. No. 3,341,791 arises from the fact that when the handle moves from the On to the Trip position there is no positive means to prevent movement of the shield. If the shield moves during this motion of the handle, then when the handle is in the Trip position the "On" indicia carried by the handle apron will be visible through the lost motion aperture in the shield to give false indication that the circuit breaker is closed. To alleviate this condition, the instant invention provides a latch means which positively acts to hold the shield from moving while the handle moves from the On to the Trip position so that when the handle is in the Trip position the shield will cover the "On" indicia on the handle apron.

In particular, the shield of the instant invention is a molded insulating member of arcuate shape having integrally formed forwardly extending tabs which cooperate with a blocking formation on the inside of the cover to latch the shield against movement while the handle moves from its On to its Trip position. The shield also includes integrally formed ribs on the forward surface thereof, which ribs extend into complementary slots in the inside arcuate surface portion of the cover. Cooperation between the ribs and slots results in the formation of labyrinth seals which effectively block gases which attempt to exit through the handle aperture at the long sides thereof. This molded shield member is captivated to the handle by a mere snap-fit.

Accordingly, a primary object of the instant invention is to provide a novel construction for a shield which is mounted to a circuit breaker handle with a lost motion connection so as to cooperate with the handle apron in completely sealing the handle aperture for all positions of the handle.

Another object is to provide a shield of this type which is captivated to the handle.

Still another object is to provide a shield of this type having a latch means which will assure that the shield will cover "On" indicia on the apron when the handle is in the Trip position.

A further object is to provide a shield of this type having improved means to block gases from exiting through the handle aperture.

A still further object is to provide a shield of this type which is a molded insulating member.

These objects as well as other objects of this invention shall become readily apparent after reading the following description of the accompanying drawings in which:

In FIG. 1 the circuit breaker handle is shown in the Trip position.

Figure 1:
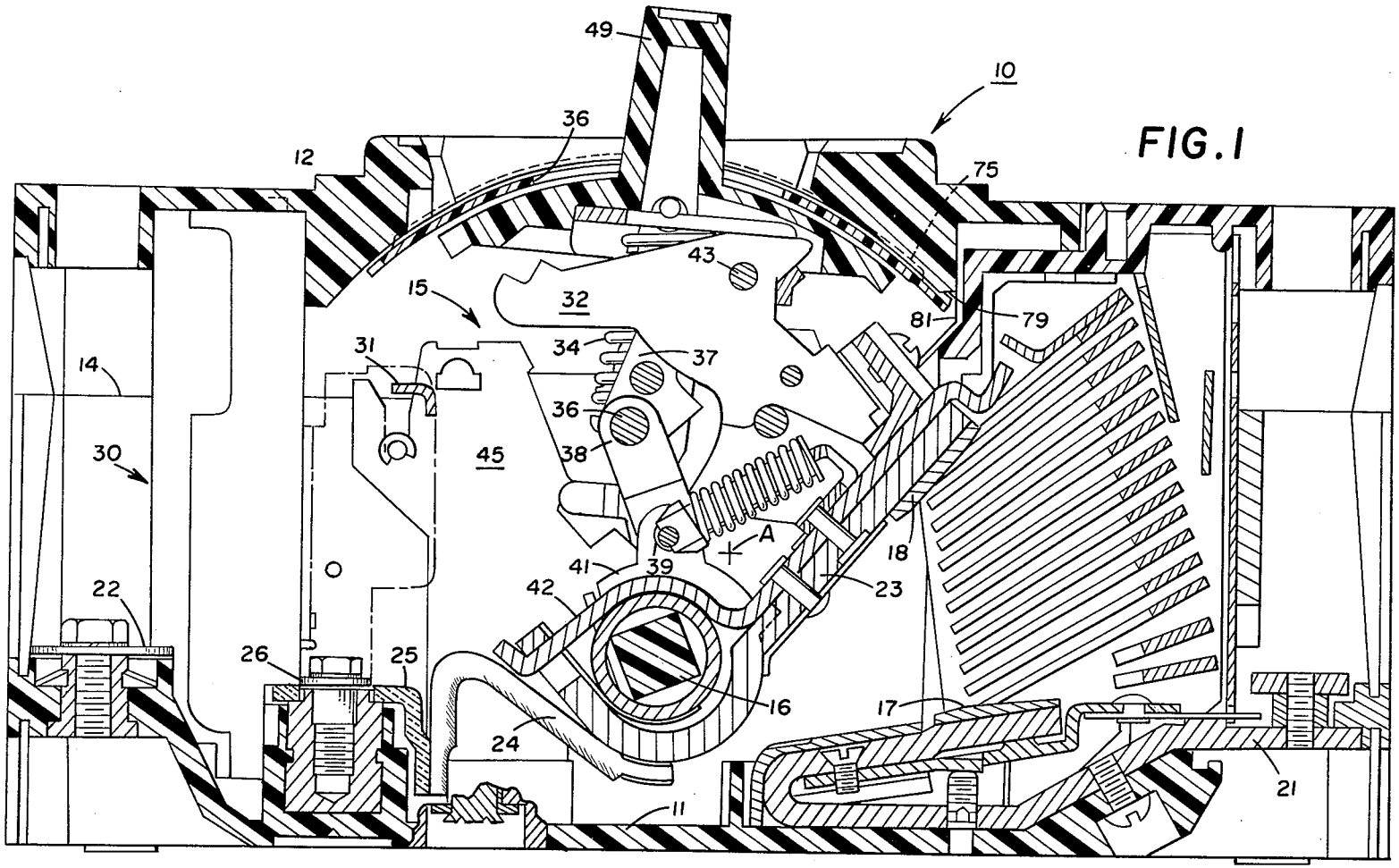
FIG. 1 is a longitudinal cross-section taken through the center pole of a three-pole multicase circuit breaker having a shield constructed in accordance with teachings of the instant invention.

Now referring to the Figures. Circuit breaker 10 is a multipole molded case unit having a single trip-free contact operating mechanism 15 which is mechanically connected by transverse tie rod to open and close the cooperating contacts 17-18 of all poles. Mechanism 15 is disposed within a molded insulating housing consisting of base 11 and removable front cover 12 which mate along line 14.

Since the current carrying elements of each of the poles are essentially identical the current carrying elements of only one pole shall be described herein with particular reference to FIG. 1. That is, the current path between line terminal strap 21 and load terminal strap 22 comprises stationary contact 17 mounted at one end of strap 21, movable contact 18 at one end of movable contact arm 23, flexible braid 24 extending between the other end of contact arm 23 and inverted L-shaped strap 25, terminal element 26 of fault current sensing automatic trip means 30, and a conductor (not shown) which extends through trip unit 30 and whose opposite ends constitute terminals 22 and 26. Trip unit 30 also includes trip latch 31 for releasably holding cradle 32 of mechanism 15 in the latched position of FIG. 2, and thermal-magnetic means (not shown), of a type known to the art, for automatically tripping latch 31 upon the occurrence of predetermined fault conditions. Cradle 32 is mounted for pivotal movement about an axis (indicated by cross A in FIG. 1) remote from latching tip 33 of cradle 32.

Contact operating mechanism 15 is a spring powered device which also includes main operating springs 34,34 connected between U-shaped operating member 35 and knee 36 of a toggle including links 37,38 which are connected at knee 36. The end of link 38 remote from knee 36 is pivotally connected by pin 39 to guide plate 41 which is keyed to tie rod 16 and is operatively engageable with transverse extensions (not shown) of steel strip 42 mounted on the forward surface of movable contact arm 23. The end of arm 23 remote from movable contact 18 is pivotally connected to rod 16 in a manner which is not described herein because such connection is not part of the instant invention. The end of link 37 remote from knee 36 is pivotally connected to cradle 32 by pin 43.

Figure 3:
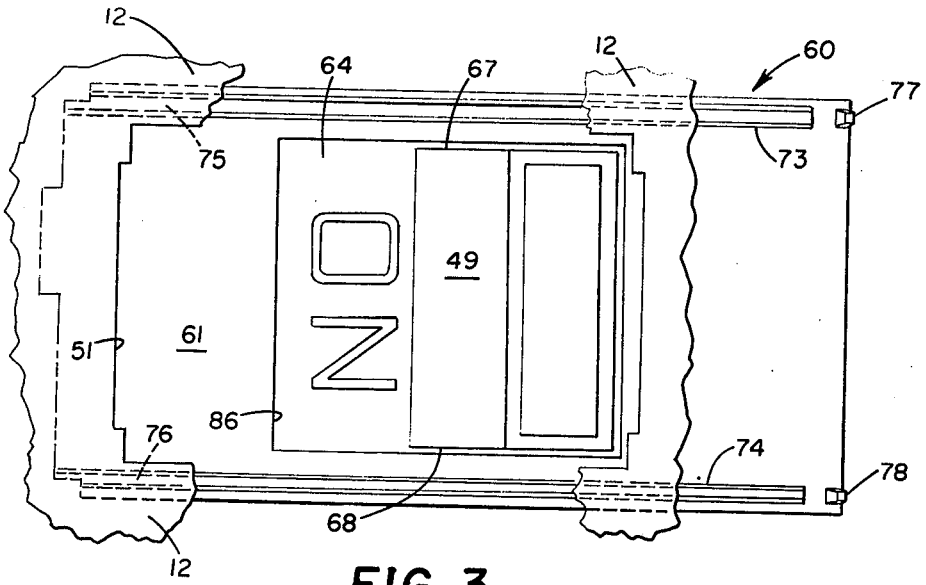
FIG. 3 is a fragmentary plan view looking in the direction of arrows 3—3 of FIG. 2.

Springs 34 are in tension and urge the free ends 44 of actuating member 35 against pivot forming seats in the spaced arms of frame 45 which supports the elements of mechanism 15. Web portion 46 of actuator 35 extends into a complementary depression at the rear of operating handle apron 47 which also includes manually engageable handle 49. The latter extends forward of cover 12 through rectangular aperture 51 in the latter and is movable longitudinally within cover aperture 51, being manually operable between the On and Off positions indicated in FIG. 3. In a manner well known to the art, when latch 31 is tripped cradle 32 is released and, acting under the influence of main springs 34, the elements of operating mechanism 15 assume the positions shown in FIG. 1, and in particular handle 49 assumes an intermediate or Trip position shown wherein handle 49 is intermediate the On and Off positions shown in FIG. 3.

Figure 2:
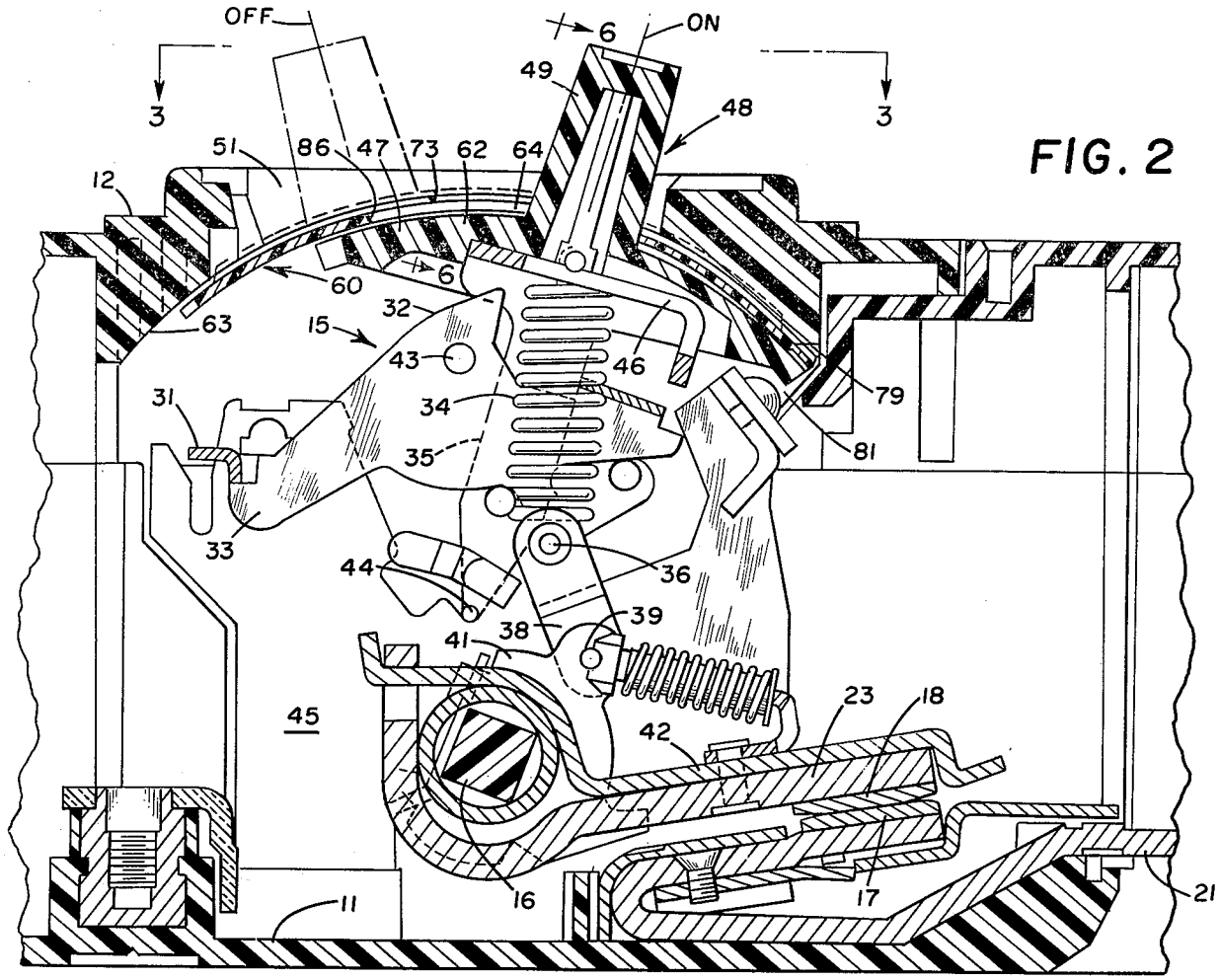
FIG. 2 is an enlarged fragmentary portion of FIG. 1 with the circuit breaker handle in the On position.

It is noted that the length of apron 47 is insufficient to assure that apron 47 will entirely close cover aperture 51 for all positions of handle 49. In FIG. 2 there is an extensive gap between the left end of apron 47 and the end boundary of cover aperture 51 to the left thereof when manual operating member 48 is in the On position.

Figure 4:
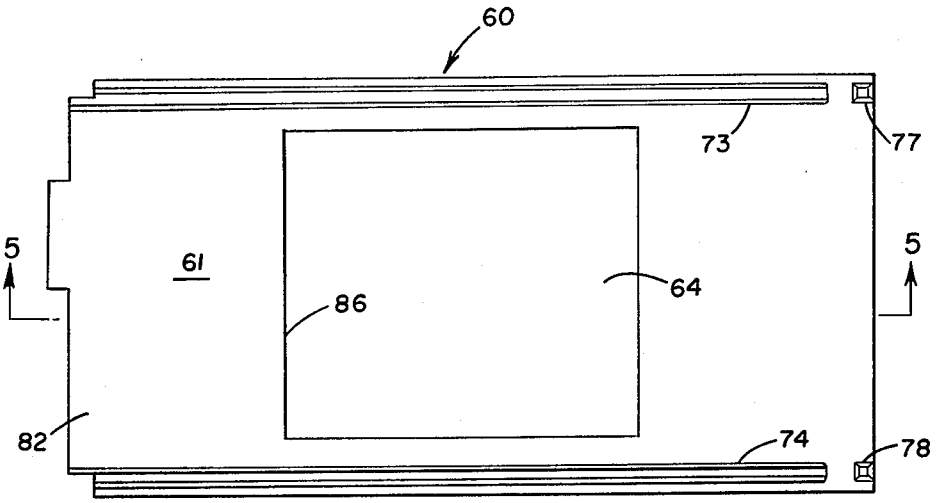
FIG. 4 is a plan view of the shield.
Figure 5:
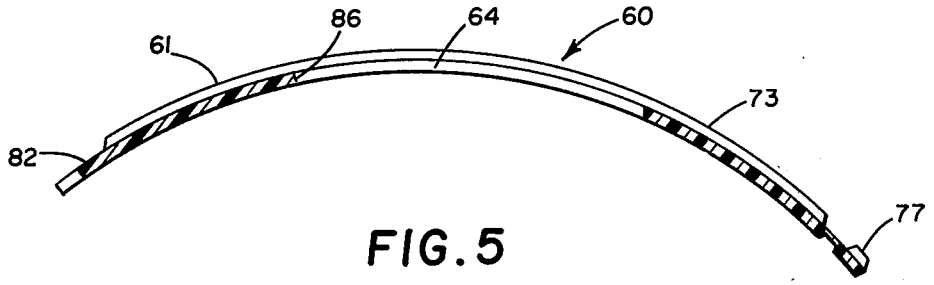
FIG. 5 is a side elevation of the shield looking in the direction of arrows 5—5 of FIG. 4.

Since leaving a portion of cover aperture 51 open may result in a very dangerous situation, shield 60 is interposed between apron 47 and cover 12. Shield 60 is a thin resilient member molded of plastic insulating material. In the unstressed state, as in FIG. 4, main section 61 of shield 60 is arcuate and generally rectangular, being generally concentric with the arcuate forward surface 62 of apron 47 and arcuate inner surface portion 63 of cover 12 through which cover aperture 51 extends. Handle 49 extends through rectangular aperture 64 in main section 61. Aperture 64 is substantially greater in its dimension measured longitudinally of cover aperture 51 than is the dimension of handle 49, thereby permitting relative motion between manual operating member 48 and shield 60, for a reason which will hereinafter be explained.

Figure 6:
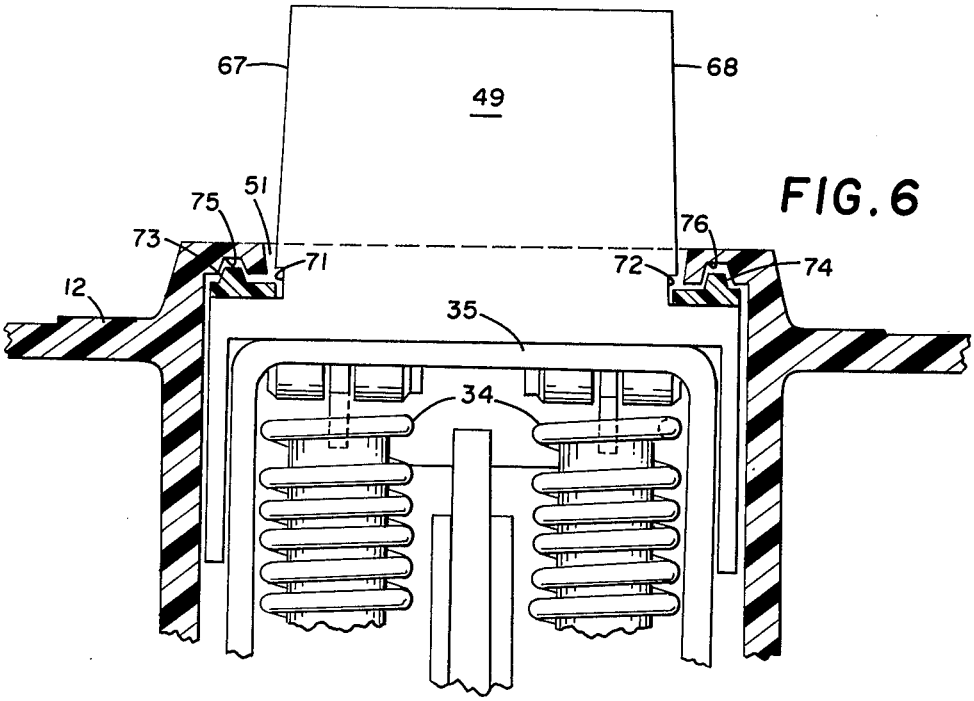
FIG. 6 is a fragmentary cross-section taken through lines 6—6 of FIG. 2 looking in the direction of arrows 6—6.

As seen in FIG. 6, the opposed sides 67,68 of handle 49 slope gradually in opposite directions, being closest at their forward ends. The rear ends of sides 67,68 are undercut to form recesses 71,72, respectively, which receive portions of main section 61 which define the longitudinal boundaries of shield aperture 64. The width of shield aperture 64 is slightly greater than the spacing between recesses 71,72 but is less than the spacing between handle ends 67,68 just forward of recesses 71,72. To mount shield 60 on handle 49 the former is forced rearward along sides 67,68. This forces the side boundaries of aperture 64 to spread until they are in alignment with recesses 71,72 at which point the resilient nature of shield 60 causes these boundary portions to snap into recesses 71,72 to retain shield 60 mounted on handle 49 yet permit relative movement between these elements.

Shield 60 also includes integrally formed ribs 73,74 disposed adjacent the longitudinal sides thereof and extending forward of main section 61. Ribs 73,74 extend into the respective longitudinally extending slots 75,76 in the arcurate rear surface portion of cover 12. Slots 75,76 are on opposite sides of cover aperture 51 (see FIG. 6). Ribs 73, 74 entered into longitudinal grooves 75, 76 form labyrinth-type seals which prevent excessive quantities of arcing gases from exiting through cover aperture 51 along the longitudinal ledges thereof.

Disposed at one end of shield 60 in alignment with ribs 73,74 are forwardly extending latching tabs 77,78. The latter cooperate with internal cover formation 79 to positively hold shield 60 against movement while handle 49 moves from the On position of Fig. 3 to the Trip position of FIG. 1. More particularly, the forward arcuate surface of apron 47 is provided with ON indicia (FIG. 2) which should be viewable only when contacts 17,18 are closed. When handle 49 is in the On position of FIG. 3 the ON indicia will always be viewable through shield aperture 64 since cover formation 81 blocks movement of shield 60 to the right with respect to FIG. 3. As handle 49 moves from its On position of FIG. 3 to its Trip position of FIG. 1, shield 60 remains stationary in that the engagement of tabs 77,78 with cover formation 79 blocks movement of shield 60 insofar as frictional forces which may develop between shield 60 and apron 47 as the latter moves to the left with respect to FIG. 3. With handle 49 in the Trip position the ON indicia on cradle 47 moves behind the portion 82 of shield 60 and is no longer visible.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A circuit breaker including contact means; a trip free operating mechanism connected to said contact means for opening and closing thereof; fault current responsive trip means for automatically actuating said mechanism to open said contact means upon the occurrence of predetermined fault current conditions; a housing to which said contact means, said mechanism and said trip means are mounted; said housing including a front wall having an arcuate internal surface portion and an elongated wall aperture extending through said surface portion; said mechanism including a manual operating means comprising an apron having an arcuate front surface disposed behind said arcuate surface portion and a handle extending from the front of said apron and through said wall aperture; said handle being mounted for reciprocable movement in said wall aperture longitudinally thereof between circuit breaker On and Off positions; said handle being moved automatically to a Tripped position, intermediate said On and Off positions, upon actuation of said mechanism by said trip means; a thin elongated shield interposed between said arcuate front surface and said arcuate surface portion; said shield being substantially longer than said apron and having a shield aperture through which said handle extends; said shield aperture having a dimension measured longitudinally of the wall aperture that is substantially greater than the dimension of said handle measured longitudinally of the wall aperture to form a lost-motion connection between the handle and the shield whereby for all positions of said handle the ends of the shield extend beyond the ends of the wall aperture and the latter is closed through cooperation of the shield and the apron; said arcuate surface bearing indicia viewable through the shield aperture when the handle is in said On position to indicate that the circuit breaker is closed; said handle when in said On position carrying said shield to a first position; and latch means for positively maintaining said shield in said first position while said handle moves from said On position to said Trip position, with said handle in said Trip position and said shield in said first position the latter blocks said indicia from view.

2. A circuit breaker as set forth in claim 1 in which the shield, in its free state, is an arcuate member.

3. A circuit breaker as set forth in claim 1 in which the latch means includes first means protruding from said shield forward of said arcuate surface and engageable with a blocking formation on the inside of said wall; with said handle in said On position said blocking formation being interposed between said wall aperture and said first means; as said handle moves from said Trip position to said Off position said first means moving past said blocking formation toward said wall aperture as an end section of said apron is deflected rearward.

4. A circuit breaker as set forth in claim 3 in which the shield is an arcuate member and the first means is formed integrally with the shield.

5. A circuit breaker as set forth in claim 1 in which the shield and the wall have rib means and slot means extending longitudinally of the wall aperture; said rib means extending into said slot means to cooperate therewith and form labyrinth-type seals which block gases attempting to exit the housing along the longitudinal edges of the wall aperture.

6. A circuit breaker as set forth in claim 5 in which the ribs extend forward from the arcuate surface adjacent opposite edges thereof; said slot means being in said arcuate surface portion on opposite sides of said wall aperture.

7. A circuit breaker as set forth in claim 6 in which the latch means includes first means protruding from said shield forward of said arcuate surface and engageable with a blocking formation on the inside of said wall; with said handle in said On position said blocking formation being interposed between said wall aperture and said first means; as said handle moves from said Trip position to said Off position said first means moving past said blocking formation toward said wall aperture and by so doing forcing an end section of said apron to be deflected rearward; said first means comprising tabs which are aligned with said slot means and are received thereby as the handle moves from said Trip to said Off position.

8. A circuit breaker as set forth in claim 7 in which the shield is an arcuate member, said first means and said rib means being formed integrally with the shield.

9. A circuit breaker including contact means; a trip free operating mechanism connected to said contact means for opening and closing thereof; fault current responsive trip means for automatically actuating said mechanism to open said contact means upon the occurrence of predetermined fault current conditions; a housing to which said contact means, said mechanism and said trip means are mounted; said housing including a front wall having an arcuate internal surface portion and an elongated wall aperture extending through said surface portion; said mechanism including a manual operating means comprising an apron having an arcuate front surface disposed behind said arcuate surface portion and a handle extending from the front of said apron and through said wall aperture; said handle being mounted for reciprocable movement in said wall aperture longitudinally thereof between circuit breaker On and Off positions; said handle being moved automatically to a Tripped position, intermediate said On and Off positions, upon actuation of said mechanism by said trip means; a thin elongated shield interposed between said arcuate front surface and said arcuate surface portion; said shield being substantially longer than said apron and having a shield aperture through which said handle extends; said shield aperture having a dimension measured longitudinally of the wall aperture that is substantially greater than the dimension of said handle measured longitudinally of the wall aperture to form a lost-motion connection between the handle and the shield whereby for all positions of said handle the ends of the shield extend beyond the ends of the wall aperture and the latter is closed through cooperation of the shield and the apron; and means defining a snap-fit-type connection securing said shield to said manual operating means.

10. A circuit breaker as set forth in claim 9 in which the means defining said snap-fit-type connection includes recesses in opposite sides of said handle disposed adjacent so said apron and wherein boundary portions of said shield defining said shield aperture are disposed; said boundary portions being along opposite sides of said shield aperture; said opposite sides extending longitudinally of said wall aperture.

11. A circuit breaker as set forth in claim 10 in which the opposite sides of said handle are gradually tapered, being closer together at their free ends than the ends thereof disposed immediately forward of said recesses.

12. A circuit breaker as set forth in claim 1 also including means defining a snap-fit-type connection securing said shield to said manual operating means.

* * * * *